US009588474B2

(12) United States Patent
Tomoe et al.

(10) Patent No.: US 9,588,474 B2
(45) Date of Patent: Mar. 7, 2017

(54) IMAGE FORMING APPARATUS

(71) Applicant: CANON KABUSHIKI KAISHA, Tokyo (JP)

(72) Inventors: Kentarou Tomoe, Susono (JP); Takateru Ohkubo, Susono (JP); Keita Nakajima, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/921,379

(22) Filed: Oct. 23, 2015

(65) Prior Publication Data

US 2016/0124350 A1 May 5, 2016

(30) Foreign Application Priority Data

Oct. 29, 2014 (JP) ..... 2014-219968

(51) Int. Cl.

| | |
|---|---|
| ***G03G 15/16*** | (2006.01) |
| ***G03G 15/00*** | (2006.01) |
| ***B65H 7/20*** | (2006.01) |
| ***B65H 3/06*** | (2006.01) |

(52) U.S. Cl.

CPC ..... *G03G 15/65* (2013.01); *B65H 3/06* (2013.01); *B65H 7/20* (2013.01); *G03G 15/6502* (2013.01); *G03G 15/6511* (2013.01); *G03G 15/6558* (2013.01)

(58) Field of Classification Search

None

See application file for complete search history.

(56) References Cited

U.S. PATENT DOCUMENTS

| | | | | |
|---|---|---|---|---|
| 8,340,563 | B2 | 12/2012 | Nakajima et al. | |
| 2008/0232843 | A1* | 9/2008 | Kobayashi | G03G 15/6555 399/90 |
| 2010/0129121 | A1* | 5/2010 | Ichikawa | G03G 15/1695 399/316 |
| 2012/0321332 | A1* | 12/2012 | Yanagi | G03G 15/1605 399/66 |
| 2015/0016856 | A1 | 1/2015 | Ohkubo et al. | |

FOREIGN PATENT DOCUMENTS

JP 11-157686 A 6/1999

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

An image forming apparatus includes a sheet stacking portion, a feed portion, a transfer portion transferring a toner image on a sheet fed by the feed portion, and a switching portion. The switching portion switches the sheet stacking portion between a grounded condition in which the sheet stacking portion is electrically earthed and an insulated condition in which the sheet stacking portion is electrically insulated. The sheet stacking portion is switched into the insulated condition in a state in which the transfer bias is applied and the sheet stacking portion is switched into the grounded condition in a state in which no transfer bias is applied.

9 Claims, 7 Drawing Sheets

IMAGE FORMING APPARATUS

BACKGROUND OF THE INVENTION

Field of the Invention

The present invention relates to an image forming apparatus adopting an electro-photographic recording system such as a copier, a facsimile, a laser beam printer, a multi-function printer, and the like.

Description of the Related Art

Lately, there is produced a low-cost and space-saving image forming apparatus adopting an electro-photographic system such as a copier, a facsimile, a laser printer, a multi-function printer, and the like. Such image forming apparatus is widespread not only in offices but also in small offices and in homes for personal use, thus creating an environment of enabling to self-manufacture a small amount of various kinds of prints such as leaflets, bills, catalogs, and the like. Under such circumstances, the image forming apparatus is naturally required to be able to enhance image quality and to be highly adaptable to various kinds of sheets.

What is demanded most among the various kinds of sheets is a coated sheet, i.e., a sheet whose smoothness and appearance are enhanced by coating a surface of a high quality sheet. Because the coated sheet is glossy, highly smooth, can clearly reproduce a photograph and characters, and provides high quality finish as features of the coated sheet, the coated sheet can be suitably used for leaflets, bills, catalogs and others described above.

Meanwhile, the coated sheet has a problem that a surface layer face of the coated sheet is liable to absorb moisture and the coated sheets overlapping with each other are liable to adsorb with each other if a bundle of coated sheets is left under a highly humid environment. Due to that, the coated sheet is liable to cause such problems as double feeding of conveying multiple coated sheets while overlapping with each other and as feed failure of not conveying any sheet.

Then, conventionally, Japanese Patent Application Laid-open No. Hei.11-157686 proposes a technology of restraining the adsorption of the sheets by blowing air to side faces and an upper face of the sheets stacked on a sheet stacking portion to separate the sheets in an image forming apparatus.

However, there is a case when the double feeding occurs because overlapping sheets adsorb with each other by an electrostatic force, beside the adsorption caused by humidity absorbed in a highly humid environment, because smoothness of the sheet face of the coated sheet is high in particular. The sheets stacked on the sheet stacking portion are put into a charged state in the electro-photographic system in particular because high voltage is applied to the sheet to transfer a toner image onto the sheet in a transfer portion and the transfer current flows into the sheets stacked on the sheet stacking portion.

In a case where a distance between the transfer portion and the sheet stacking portion cannot be fully assured due to downsizing of the apparatus in the electro-photographic system image forming apparatus, a sheet on which a toner image is to be transferred in the transfer portion is in contact with a sheet on the sheet stacking portion such that parts thereof overlap with each other. Still further, an entire resistance value of the sheets stacked on the sheet stacking portion decreases in cases when a resistance value of a material of the sheet is small or an amount of the sheets stacked on the sheet stacking portion is small in the condition in which the sheet stacking portion is earthed. Under such circumstance, a potential difference between the sheet being charged during the transfer and the sheet stacked on the sheet stacking portion increases, thus generating an electrostatic force. The double feeding occurs because the sheets adsorb with each other by this electrostatic force (electrostatic adsorption). Then, if the adsorption between the sheets caused by the electrostatic force is strong, it is unable to separate the sheets even by a sheet separating operation of the sheet feeding portion, and the sheets are conveyed to the transfer portion while being overlapped. Such circumstance occurs remarkably in the case of the coated sheet.

It is unable to separate the sheets adsorbed with each other by the electrostatic force by the configuration of blowing air as described above.

Then, it is conceivable to prevent the double feeding caused by the electrostatic force by suppressing the potential difference between the sheets by enhancing insulating performance of the sheet stacking portion. However, electric charge is gradually accumulated in the sheets on the sheet stacking portion and in the components in the process of consecutively conveying the sheets. Then, if the charge exceeds a certain threshold value, there is a possibility of generating electrostatic noise, thus causing such problems as erroneous operations of electronic components within the image forming apparatus.

SUMMARY OF THE INVENTION

According to a first aspect of the invention, an image forming apparatus includes a sheet stacking portion on which a sheet is stacked, a feed portion feeding the sheet stacked on the sheet stacking portion, a transfer portion transferring a toner image onto the sheet fed by the feed portion by a transfer bias applied thereto, and a switching portion switching the sheet stacking portion between a grounded condition in which the sheet stacking portion is electrically earthed and an insulated condition in which the sheet stacking portion is electrically insulated. The stacking portion is in the insulated condition in a state in which the transfer bias is applied and is in the grounded condition in a state in which no transfer bias is applied.

Still further, according to a second aspect of the invention, an image forming apparatus includes a sheet stacking portion on which a sheet is stacked, a feed portion feeding the sheet stacked on the sheet stacking portion, a transfer portion transferring a toner image onto the sheet fed by the feed portion, a switching portion switching the stacked sheet between a grounded condition in which the stacked sheet is electrically earthed and an insulated condition in which the stacked sheet is electrically insulated, and a control portion controlling the switching portion such that the stacked sheet is switched into the grounded condition in a state in which a front edge of a preceding sheet of the stacked sheet fed by the feed portion does not reach the transfer portion and such that the stacked sheet is switched into the insulated condition in a state in which the front edge of the preceding sheet whose rear edge is in contact with a succeeding sheet of the stacked sheet reaches the transfer portion.

According to a third aspect of the invention, an image forming apparatus includes a sheet stacking portion on which a sheet is stacked, a feed portion feeding the sheet stacked on the sheet stacking portion, a transfer portion transferring a toner image onto the sheet fed by the feed portion, a switching portion switching the stacked sheet between a grounded condition in which the stacked sheet is electrically earthed and an insulated condition in which the stacked sheet is electrically insulated, and a control portion controlling the switching portion such that the stacked sheet is switched into the grounded condition in a standby state during which the feed portion feeds no stacked sheet and into the insulated condition in a feed state in which the feed portion consecutively feeds the sheet while being in contact with the stacked sheet.

Further features of the present invention will become apparent from the following description of exemplary embodiments with reference to the attached drawings.

DESCRIPTION OF THE EMBODIMENTS

First Embodiment

Figure 1:
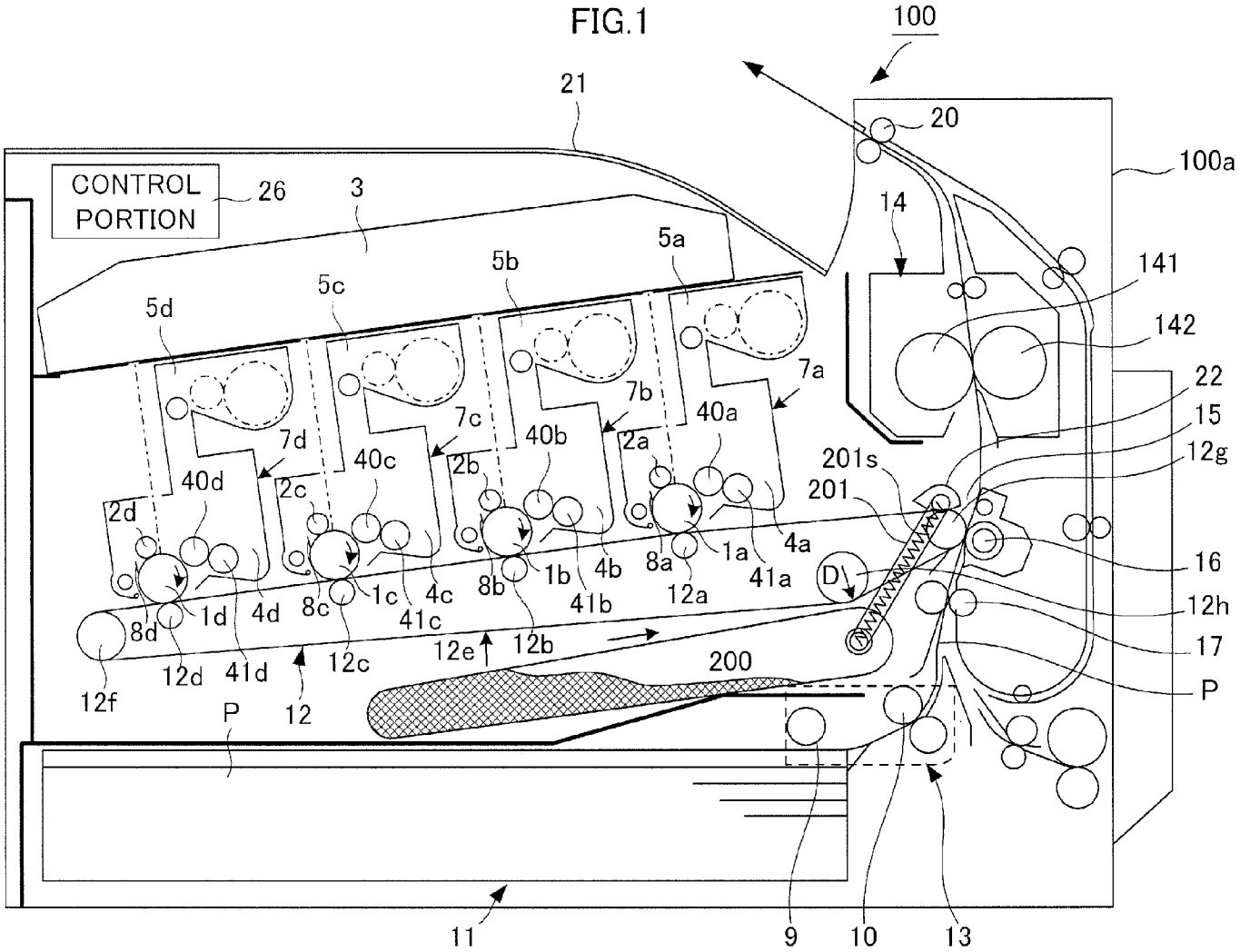
FIG. 1 is a schematic section view illustrating a configuration of an image forming apparatus of a first embodiment.

An image forming apparatus of embodiments of the present invention will be described in detail below with reference to the drawings. It is noted that the same reference numerals denote same or corresponding portions throughout the drawings. FIG. 1 is a section view schematically illustrating the image forming apparatus of the present embodiment.

As shown in FIG. 1, the image forming apparatus 100 includes an image forming apparatus body 100*a* (referred to simply as an 'apparatus body' hereinafter), and the apparatus body 100*a* includes process cartridges 7*a*, 7*b*, 7*c* and 7*d* (7*a* through 7*d*) configured to be attachable to/detachable from the apparatus body 100*a*. The apparatus body 100*a* is also provided with a control portion 26 controlling the respective portions. While the four process cartridges 7*a* through 7*d* have the same structures from each other, they are different in that they form images of different colors by toners of yellow (Y), magenta (M), cyan (C), and black (Bk).

The process cartridges 7*a* through 7*d* include developing units 4*a*, 4*b*, 4*c*, and 4*d* (4*a* through 4*d*) and toner units 5*a*, 5*b*, 5*c*, and 5*d* (5*a* through 5*d*), respectively. The developing units 4*a* through 4*d* include photosensitive drums, i.e., image bearing members, 1*a* through 1*d*, charging rollers 2*a* through 2*d*, drum cleaning blades 8*a* through 8*d*, and waste toner containers not shown, respectively. The developing units 4*a* through 4*d* include developing rollers 40*a* through 40*d* and developer applying rollers 41*a* through 41*d*.

Disposed above the process cartridges 7*a* through 7*d* is a scanner unit 3. The scanner unit 3 scans laser beams obtained by ON-OFF modulating scan line image data in which respective color separation images of Y, M, C, and Bk are developed on surfaces of the respective charged photosensitive drums 1*a* through 1*d* by polygonal mirrors not shown to draw electrostatic latent images of the image on the surfaces of the photosensitive drums 1*a* through 1*d*.

That is, the electrostatic latent images are formed by the scanner unit 3 respectively on the surfaces of the photosensitive drums 1*a* through 1*d* after when the photosensitive drums 1*a* through 1*d* are charged with predetermined negative potential by the charging rollers 2*a* through 2*d*. Negative toners are applied to the electrostatic latent images to reversely develop by the developing units 4*a* through 4*d* and to form toner images of Y, M, C, and Bk respectively on the photosensitive drums 1*a* through 1*d*.

In an intermediate transfer belt unit 12, an intermediate transfer belt 12*e* is stretched by a driving roller 12*f*, a secondary transfer counter roller 12*g*, and a tension roller 12*h*, and tension is applied to the intermediate transfer belt 12*e* by the tension roller 12*h* in a direction of an arrow D. Still further, primary transfer rollers 12*a* through 12*d* are disposed on an inner circumferential side of the intermediate transfer belt 12*e*, and transfer bias is applied to the primary transfer rollers 12*a* through 12*d* respectively by bias applying portions not shown.

The toner images formed respectively on the photosensitive drums 1*a* through 1*d* rotate in a same direction together with the photosensitive drums 1*a* through 1*d* rotating in a direction as indicated by arrows, respectively. Then, as the intermediate transfer belt 12*e* facing the photosensitive drums 1*a* through 1*d* rotates, positive bias is applied to the primary transfer rollers 12*a* through 12*d* positioned on the inner circumferential side of the intermediate transfer belt 12*e*. Thereby, the toner images are primarily transferred onto the intermediate transfer belt 12*e* sequentially from the toner image on the photosensitive drum 1*a*, and the intermediate transfer belt 12*e* is conveyed and moved to a secondary transfer portion (transfer portion) 15 in a condition in which the four color toner images are transferred and superimposed. The secondary transfer portion 15 is composed of nip portion between the secondary transfer counter roller 12*g* and a secondary transfer roller 16.

The image forming apparatus 100 includes a sheet feed cassette 11 that can be attached to/detached from the apparatus body 100*a* and that can store a sheet P. The sheet feeding apparatus 13 includes a feed roller 9 feeding the sheet P from the sheet feed cassette 11 storing the sheet P and a separating conveyance roller pair 10 conveying the fed sheet P. Then, the sheet P fed and conveyed from the sheet feeding apparatus 13 is conveyed to the secondary transfer portion 15 through a registration roller pair 17.

Disposed right upstream, in a sheet feeding direction, of the secondary transfer portion 15 is a first sheet sensor (sheet position sensor) 27 (see FIG. 2A) detecting a front edge of the sheet P approaching the secondary transfer portion 15. Still further, a second sheet sensor 28 (see FIG. 2A) detecting a rear edge of the sheet P fed by the feed roller 9 is disposed right downstream, in the sheet feeding direction, of the feed roller 9. Receiving a signal of the first sheet sensor 27 detecting the front edge of the sheet P, the control portion 26 judges that the front edge of the sheet P has entered the secondary transfer portion 15. Receiving a signal of the second sheet sensor 28 detecting the rear edge of the sheet P, the control portion 26 judges that the rear edge of the sheet P has departed from a sheet supporting member 11*b*. That is, the first sheet sensor 27 is capable of detecting whether or not the front edge of the sheet whose rear edge is in contact with a sheet stacked on the sheet supporting member 11*b* has reached the secondary transfer portion 15.

The secondary transfer portion 15 is composed of a transfer nip portion formed between the secondary transfer counter roller 12*g* and the secondary transfer roller 16 facing the secondary transfer counter roller 12*g*. In the secondary transfer portion 15, the four color toner images on the intermediate transfer belt 12*e* are secondarily transferred onto the sheet P conveyed as described above by applying positive bias applied to the secondary transfer roller 16.

Meanwhile, the sheet P on which the toner images have been transferred is conveyed to a fixing unit 14. Then, the sheet P is made undergo heat and pressure by a fixing roller 141 and a pressure roller 142 in pressure contact with the fixing roller 141, so that the toner images are fixed on the surface of the sheet P. The sheet P is discharged to a discharge tray 21 by a discharge roller pair 20.

After the transfer of the toner images, residual toners left on the respective surfaces of the photosensitive drums 1*a* through 1*d* are removed by the cleaning blades 8*a* through 8*d*. Still further, toner left on the intermediate transfer belt 12*e* after the secondary transfer to the sheet P is removed by a belt cleaning device 22. The toner thus removed is passed through the waste toner conveying path 201 and is recovered into a waste toner recovering container 200.

Figure 6:
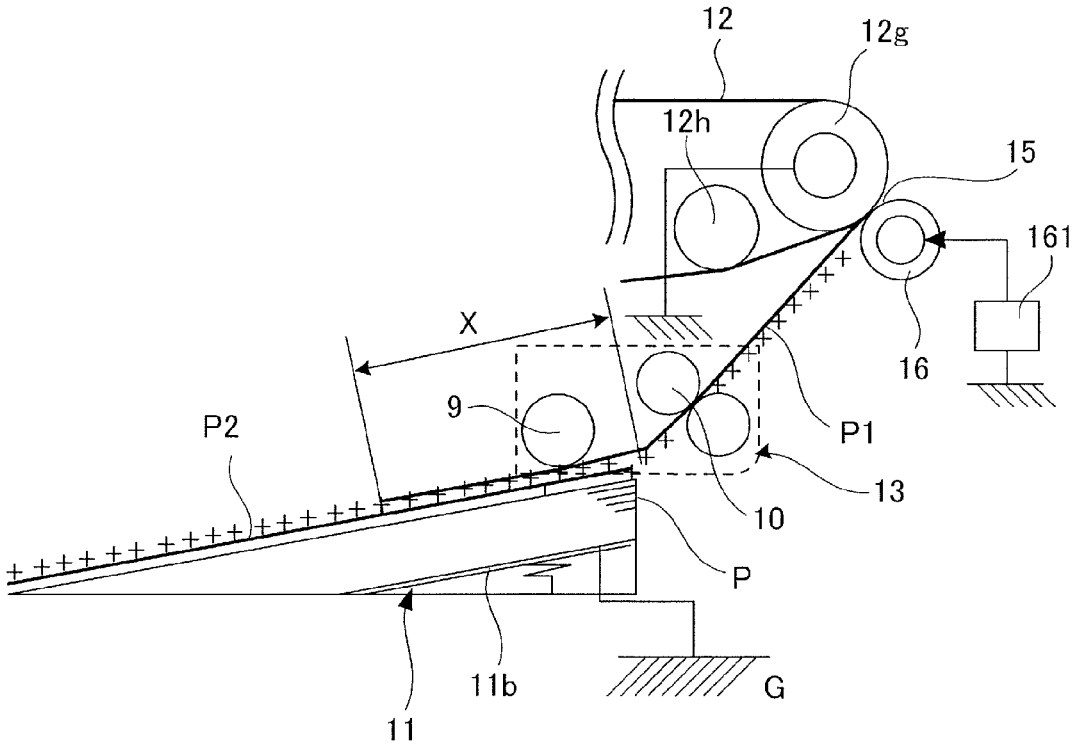
FIG. 6 is a side view schematically illustrating a sheet feeding apparatus and a secondary transfer portion in a basic technology.
Figure 7A:
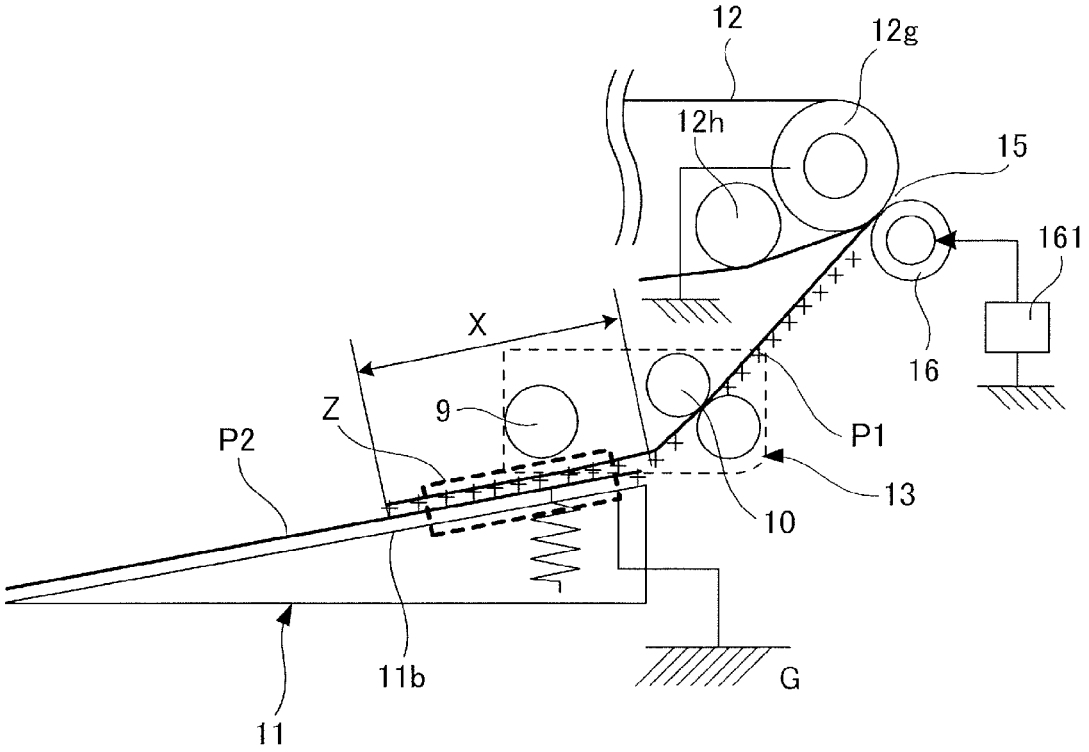
FIG. 7A is a side view schematically illustrating a state in which a succeeding sheet is earthed in a sheet feed cassette in the basic technology.
Figure 7B:
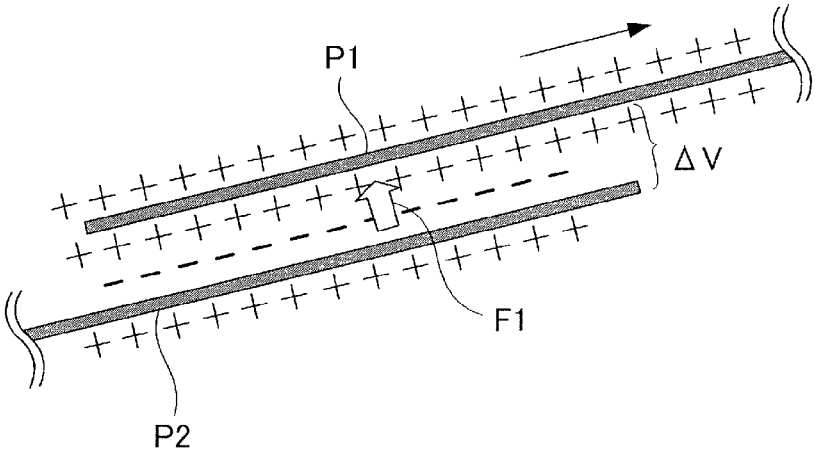
FIG. 7B is an enlarged view illustrating a part Z in FIG. 7A.

Here, a basic technology of the present embodiment will be described with reference to FIG. 6 and FIGS. 7A and 7B. It is noted that FIG. 6 is a side view schematically illustrating a sheet feeding apparatus and a secondary transfer portion of the basic technology. FIG. 7A is a side view schematically illustrating a state in which a succeeding sheet is earthed in the sheet feed cassette in the basic technology, and FIG. 7B is an enlarged view illustrating a part Z in FIG. 7A.

As shown in FIG. 6, a sheet supporting member 11*b* of the sheet feed cassette 11 is electrically connected with the ground (ground portion) G of the apparatus body 100*a* (see FIG. 1) and is earthed. However, because the sheet feeding apparatus 13 including the feed roller 9 and the separating conveyance roller pair 10 are not connected with the ground G, the sheet feeding apparatus 13 is not earthed. A mechanism of double feeding generated by adsorption of sheets caused by static electricity (referred to as 'electrostatic adsorption' hereinafter) when coated sheets are used in a configuration shown in FIG. 6 will be described.

Conductive coating is applied to a surface layer face of the coated sheet, and the surface layer face on which the coating is applied is characterized in that a resistance value is lower and conductivity is higher than those of the base paper. In response to the application of the positive transfer bias to the secondary transfer roller 16 from a transfer bias applying unit 161 and the secondary transfer is started in the secondary transfer portion 15, positive charge is applied to a preceding sheet P1 and the positive charge flows to a rear edge of the preceding sheet P1.

Then, in an apparatus in which a distance from the sheet feed cassette 11 to the secondary transfer portion 15 is shortened due to downsizing of the apparatus, a succeeding sheet P2 overlaps with the preceding sheet P1 by an overlap amount X during when the preceding sheet P1 is in a process of the secondary transfer, depending on size of the sheets. That is, if the distance from the sheet feed cassette 11 to the secondary transfer portion 15 is shorter than a length, in a sheet conveying direction, of the sheet, the preceding sheet P1 is in contact with an upper face of the stacked sheet P stacked within the sheet feed cassette 11 during when the preceding sheet P1 is in the process of the secondary transfer. Then, the further the preceding sheet P1 is conveyed downstream, the less the overlap amount X is reduced, and the sheets P1 and P2 will finish to overlap with each other at last. However, during that time, the electric charge is flown to the whole sheets P stacked within the sheet feed cassette 11 due to the contact with the preceding sheet P1. Here, if the coated sheets are fully stacked within the sheet feed cassette 11, the whole stacked sheets will be positively charged. Still further, if a charge amount of the sheet is large, surface potential of the sheet increases.

Here, if the printing process is consecutively executed under the conditions described above, a sheet stacked amount within the sheet feed cassette 11 decreases as shown in FIG. 7A.

The following phenomenon occurs in a condition in which the sheet stacked amount decreases less than a certain amount or the sheets are charged with an electric charge amount exceeding an electrostatic capacitance. That is, the electric charge flows out from the sheet supporting member 11*b* to the ground G through the small amount of sheets, i.e., the succeeding sheet P2, stored in the sheet feed cassette 11 during the secondary transfer process of the preceding sheet P1. FIGS. 7A and 7B show conditions of the secondary transfer portion 15 and the sheet feed cassette 11 in this state.

If the electrified charge flows out from the succeeding sheet P2 to the ground G on the sheet supporting member 11*b* within the sheet feed cassette 11, surface potential of the succeeding sheet P2 is temporarily zeroed. However, right after that, a dielectric phenomenon that a sheet face of the succeeding sheet P2 on a side facing the preceding sheet P1 is negatively charged and a back face thereof is positively charged occurs as shown in FIG. 7B illustrating charge conditions of the preceding and succeeding sheets P1 and P2 in a part Z in FIG. 7A.

As a result, a potential difference Δv is generated between an under face (positive) of the preceding sheet P1 and an upper face (negative) of the succeeding sheet P2. Due to that, the succeeding sheet P2 is drawn to the preceding sheet P1 by a strong electrostatic force F1 and is conveyed while being adsorbed to the preceding sheet P1. Thus, the double feeding of the sheets occurs. It is noted that the electrostatic force F1 is proportional to the potential difference Δv.

The smaller the transfer bias applied amount applied from the transfer bias applying unit 161, the smaller the charge amount of the preceding sheet P1 is and the smaller the charge amount (surface potential) of the succeeding sheet P2 charged by being in contact with the preceding sheet P1 also is. In this state, the potential difference Δv between the preceding and succeeding sheets P1 and P2 generated when the charge escapes from the succeeding sheet P2 becomes also small due to the cause described above. As a result, the electrostatic force F1 also becomes small, and it can be seen that it is possible to avoid the double feeding because the preceding sheet P1 does not electro-statically adsorb the succeeding sheet P2.

However, because the lower the humidity of an environment, the higher the surface resistance value of the coated sheet described above becomes, it is required to apply a certain or more transfer bias applying amount because transfer efficiency drops, causing transfer failure, if the transfer bias applying amount is small.

Still further, if the sheets are fed consecutively and repeatedly as described above, the entire sheet feed cassette 11 is charged along with the sheets. Then, there is a possibility of causing electrostatic noise and erroneous operations of electrical components not shown disposed within the image forming apparatus if the charge amount exceeds a certain amount.

It is then essential to suppress the electrostatic noise while keeping an insulated condition of the sheet feed cassette in order to solve the abovementioned problem.

Figure 2A:
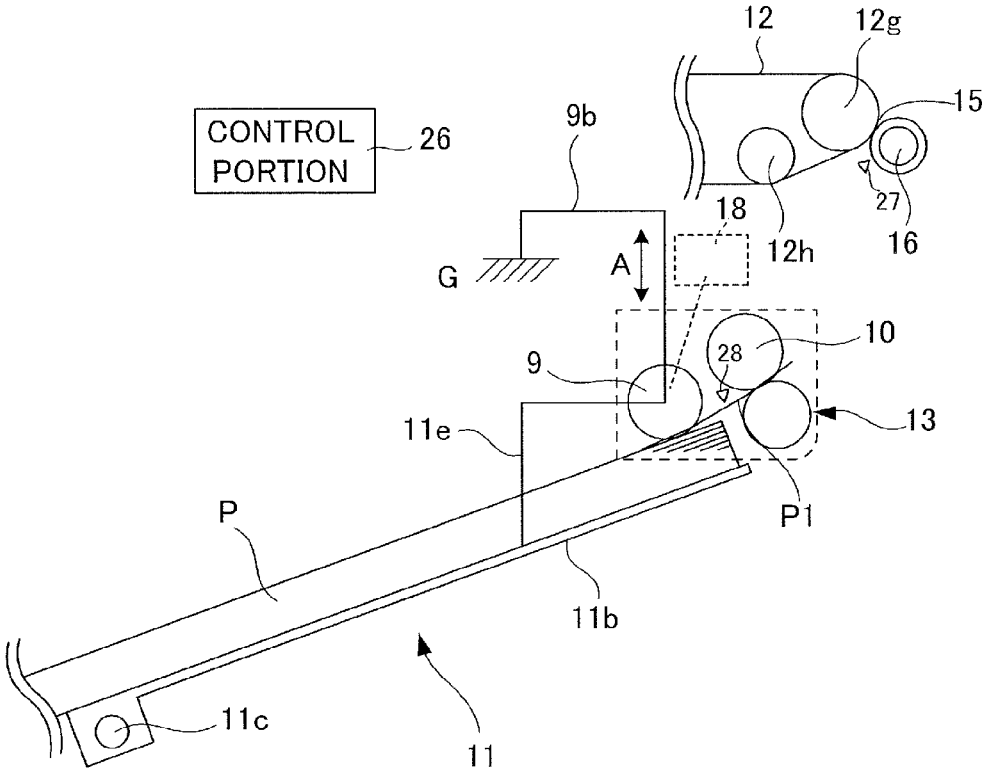
FIG. 2A is a side view schematically illustrating a state of a sheet feeding apparatus and a secondary transfer portion of the first embodiment in starting to feed a sheet.
Figure 2B:
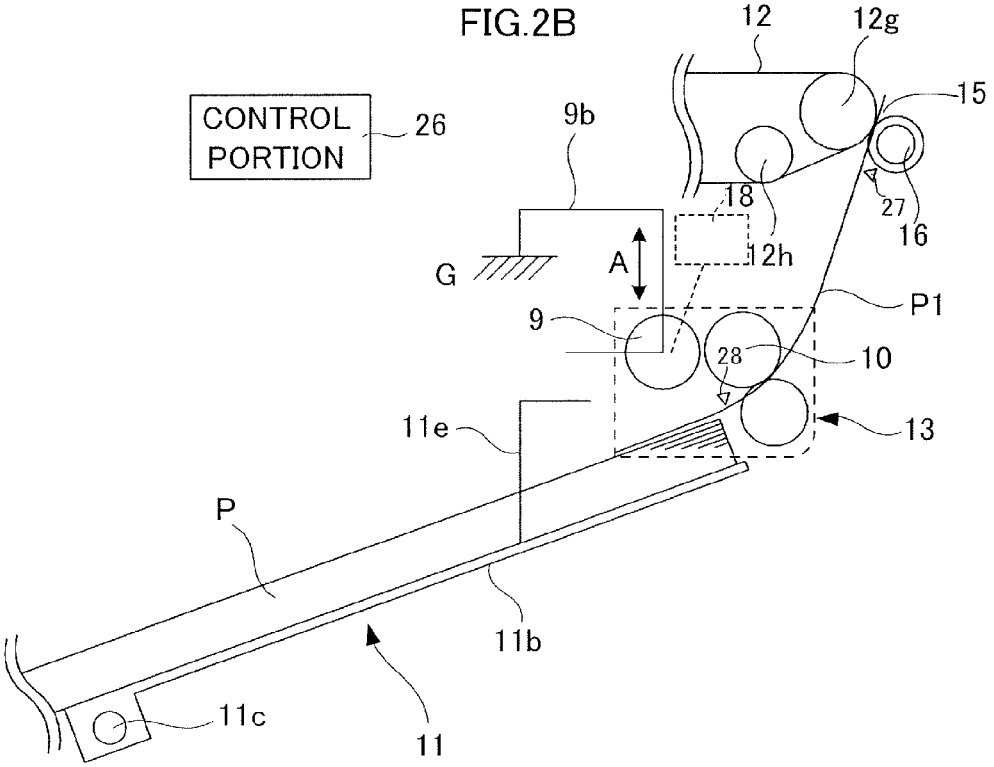
FIG. 2B is a side view schematically illustrating a state of the sheet feeding apparatus and the secondary transfer portion of the first embodiment when the sheet reaches the secondary transfer portion.

Then, a first embodiment enabling to suppress the electrostatic noise while keeping the insulated condition of the sheet feed cassette will be described in detail below with reference to FIGS. 2A and 2B. FIG. 2A is a side view schematically illustrating state of the sheet feeding apparatus 13 and the secondary transfer portion 15 of the present embodiment in starting to feed a sheet, and FIG. 2B is a side view schematically illustrating a state when the sheet reaches the secondary transfer portion 15.

At first, configurations of the sheet feeding apparatus 13 and the sheet feed cassette 11 of the present embodiment will be described. As shown in FIG. 2A, the sheet feeding apparatus 13 includes the feed roller 9 and the separating conveyance roller pair as described above. The feed roller 9 is supported movably (liftably) in a direction of an arrow A by a contact/separation device (first contact/separation device) 18 and is configured to be able to come into contact with/separate from the sheet P stored within the sheet feed cassette 11. The feed roller 9 is also connected with a conductive member 9*b* whose one end is connected with and earthed to the ground (ground portion) G. The sheet supporting member 11*b*, i.e., the sheet stacking portion, on which the sheet is stacked is configured to be liftable by a lifter mechanism lifting the sheet supporting member 11*b* by a driving force of a driving source such as a spring and a motor not shown and keeps an uppermost sheet of the sheets P stacked on the sheet supporting member 11*b* at a position where the sheet P can be fed. It is noted that the feed roller 9 composes a feed portion feeding the sheet P stacked on the sheet supporting member (sheet stacking portion) 11*b* of the sheet feed cassette 11. Still further, the conductive member 9*b* composes a first conductive member conducting with the grounding portion.

The wherein the switching portion includes a first conductive member conducted with the grounding portion and a second conductive member provided connectable with the first conductive member and conducted with the sheet stacking portion, and wherein the first and second conductive members are connected and the stacked sheet is switched into the grounded condition in response to the abutment of the feed portion with the stacked sheet by being moved by the first contacting/separating device and the connection of the first and second conductive members is disconnected and the stacked sheet is switched into the insulated condition in response to the separation of the feed portion from the stacked sheet by being moved by the first contacting/separating device. separating device 18 moves up and down the feed roller 9 by the driving portion such as a motor, a solenoid, and a cam mechanism not shown to make the feed roller 9 come into contact with/separate from the uppermost sheet of the sheets P stacked on the sheet supporting member 11*b*. The uppermost sheet is delivered as the feed roller 9 rotates in contact with the uppermost sheet of the sheets P stacked on the sheet supporting member 11*b*.

The sheet supporting member 11*b* is turnably supported by a frame body of the sheet feed cassette 11 through a spindle 11*c*. The sheet supporting member 11*b* is formed of a conductive material, and a conductive member 11*e* is attached to the sheet supporting member 11*b*. The conductive member 11*e* is configured to be connectable with another end of the conductive member 9*b* connected with and earthed to the ground (ground portion) 9 corresponding to the lift of the feed roller 9. That is, the conductive member 11*e* is connected with the conductive member 9*b* when the feed roller 9 is lowered. The sheet supporting member 11*b* and the sheet feed cassette 11 are insulated from the apparatus body 100*a* and due to that, the sheet supporting member 11*b* is earthed to the ground (ground portion) G when the conductive member 11*e* is connected with the conductive member 9*b*. It is noted that the conductive member 11*e* composes a second conductive member configured to be connectable with the conductive member (first conductive member) 9*b* and conducted with the sheet supporting member (sheet stacking portion) 11*b*. The contacting/separating device 18 moves at least either one of the feed roller 9 and the sheet supporting member 11*b* to bring the feed roller 9 into contact with/separate from the stacked sheet and also switches the sheet supporting member 11*b* between a grounded condition and an insulated condition.

The secondary transfer portion 15 is disposed at a position where the secondary transfer portion 15 can be in contact with the front edge of the preceding sheet P1 whose rear edge is located on the sheet supporting member 11*b*, i.e., on the sheet stacking portion, after being fed from the sheet feed cassette 11 by the feed roller 9. The secondary transfer portion 15 composes a transfer portion transferring a toner image on the preceding sheet P1 fed by the feed roller 9 by a transfer bias applied to the secondary transfer portion 15. Still further, according to the present embodiment, the conductive members 9*b* and 11*e* and the contacting/separating device 18 compose a switching portion switching the sheet supporting member 11*b* between the grounded condition (charge discharging condition) in which the sheet supporting member 11*b* is electrically earthed and the insulated condition in which the sheet supporting member 11*b* is electrically insulated. That is, the switching portion is capable of switching the sheet supporting member 11*b* between the grounded condition in which the sheet supporting member 11*b* is electrically earthed and the insulated condition in which the sheet supporting member 11*b* is electrically insulated. That is, the switching portion switches the sheet supporting member 11*b* into the insulated condition in a state in which the transfer bias is applied and into the grounded condition in a state in which no transfer bias is applied.

The control portion 26 of the present embodiment controls the switching portion (9*b*, 11*e*, 18) such that the sheet supporting member 11*b* is switched into the grounded condition in a first state (see FIG. 2A) during which the front edge of the sheet P on the sheet feed cassette 11 does not reach the secondary transfer portion 15. The control portion 26 also controls the switching portion (9*b*, 11*e*, 18) such that the sheet supporting member 11*b* is switched into the insulated condition in a second state (see FIG. 2B) in which the front edge of the sheet P fed by the feed roller 9 and whose rear edge is located on the sheet supporting member 11*b* reaches the secondary transfer portion 15.

As described above, the sheet supporting member 11*b* on which the sheet P is stacked is switched into the grounded condition by being connected with the ground G by the switching portion (9*b*, 11*e*, 18) and is switched into the insulated condition in which such connection is disconnected by the switching portion. This configuration makes it possible to switch the sheet supporting member 11*b*, on which the sheet P is stacked, between the grounded condition and the insulated condition.

The control portion 26 controls the contacting/separating device 18 to connect the conductive member 9*b* with the conductive member 11*e* in linkage with the operation of bringing the feed roller 9 in contact with the sheet P on the sheet supporting member 11*b* in the first state. That is, the control portion 26 controls the switching portion (9*b*, 11*e*, 18) so as to switch the sheet supporting member 11*b* between the grounded condition and the insulated condition every time when one sheet stacked on the sheet supporting member 11*b* is fed. Thereby, the sheet supporting member 11*b* is connected with the ground (ground portion) G and is switched into the grounded condition. Still further, the control portion 26 controls the contacting/separating device 18 to disconnect the conductive member 9*b* from the conductive member 11*e* in linkage with the operation of separating the feed roller 9 from the sheet P on the sheet supporting member 11*b* and switches the sheet supporting member 11*b* into the insulated condition in the second state.

Still further, the control portion 26 detects whether or not the front edge of a preceding sheet whose rear edge is in contact with a succeeding sheet of the stacked sheet has reached the secondary transfer portion 15 by the first sheet sensor 27 and switches the sheet supporting member 11*b* into the insulated condition based on a detected result that the front edge of the preceding sheet whose rear edge is in contact with the succeeding sheet of the stacked sheet has reached the secondary transfer portion 15.

Next, operations of the sheet feeding apparatus 13 and the sheet feed cassette 11 of the present embodiment will be described below with reference to FIGS. 2A and 2B.

As shown in FIG. 2A, the feed roller 9 is made abut with the upper face of the sheet P stacked on the sheet supporting member 11*b* by the contacting/separating device 18 in feeding the sheet P1 within the sheet feed cassette 11. Still further, when the feed roller 9 is lowered to abut with the sheet P, the conductive member 9*b* connected with the feed roller 9 is lowered together with the feed roller 9. Then, the conductive member 9*b* is connected and conducts with the conductive member 11*e* of the sheet supporting member 11*b*. Then, the sheet supporting member 11*b* is put into the condition of being connected with the ground G, so that the sheet supporting member 11*b* and the sheet P are neutralized.

Then, as shown in FIG. 2B, in response to the arrival of the front edge of the preceding sheet P1 at the secondary transfer portion 15 after ending the feeding operation, the feed roller 9 is lifted by the contacting/separating device 18 and is separated from a succeeding sheet P stored within the sheet feed cassette 11. As timing for separating the feed roller 9 from the succeeding sheet P, the control portion 26 controls the contacting/separating device 18 to lift up the feed roller 9 based on a signal of the first sheet sensor 27 detecting the front edge of the preceding sheet P for example.

When the feed roller 9 is lifted and is separated from the sheet P, the conductive member 9*b* on the feed roller 9 side is separated from the conductive member 11*e* on the sheet supporting member 11*b* side, and the sheet supporting member 11*b* and the sheets P stacked on the sheet supporting member 11*b* are switched into the insulated condition. It is noted that at this point of time, the sheet P within the sheet feed cassette 11 and the sheet supporting member 11*b* are charged through the preceding sheet P1 by the transfer bias received at the secondary transfer portion 15.

When the sheet supporting member 11*b* starts the feed operation again from the insulated condition, the feed roller 9 is lowered and comes into contact with an upper face of the sheet P stacked on the sheet supporting member 11*b*. Thereby, the conductive member 9*b* on the feed roller 9 side comes into contact and conducts with the conductive member 11*e* on the sheet supporting member 11*b* side, and the electric charge charging the sheet P and the sheet supporting member 11*b* is discharged to the ground G. For instance, the control portion 26 controls the contacting/separating device 18 based on a signal of the second sheet sensor 28 detecting the rear edge of the sheet P to lower the feed roller 9 such that the feed roller 9 comes into contact with the upper face of the sheet P. Thus, it is possible to reliably prevent the electrostatic noise otherwise causing the erroneous operation of the electronic components from being generated. According to the present embodiment, the feed roller 9 is lowered and lifted every time when the sheets are delivered one by one and the charge and discharge of the sheet P and the sheet supporting member 11*b* are repeated.

According to the present embodiment described above, it is possible to prevent double feeding and feed failure otherwise caused by the electrostatic adsorption, to prevent the electrostatic noise, and to reduce a relative difference of the surface potentials of the overlapping sheets being in the transfer process. Then, because the electric charge is discharged per every sheet and the electrostatic force is reduced accordingly, it is possible to prevent the double feeding more effectively. Accordingly, it is possible to provide the high quality image forming apparatus 100 which is capable of reliably preventing the double feeding and the feed failure, otherwise caused by the electrostatic force of the coated sheets, which is downsized and space-saving, and whose operation is stabilized. Thus, because no electrostatic force and adsorption phenomenon are generated even in the case when the rear edge of the sheet is located on the sheet supporting member 11*b* during the transfer onto the sheet in the secondary transfer portion 15, it is possible to make the conventional structure of separation by air to effectively function even when the present embodiment is applied to the conventional structure.

It is noted that instead of the conductive member 11*e* described above, the feed roller 9 may be configured as a conductive roller and may be brought into contact with the sheet P stacked on the sheet supporting member 11*b* to earth to the ground G. In this case, because the sheet supporting member 11*b* and the sheet feed cassette 11 are insulated with respect to the apparatus body 100*a*, the electric charge of the sheet supporting member 11*b* and the sheet P is discharged through the feed roller 9 and the conductive member 9*b*. It is possible to obtain the similar advantageous effect with what described above also by this configuration.

Second Embodiment

Figure 3A:
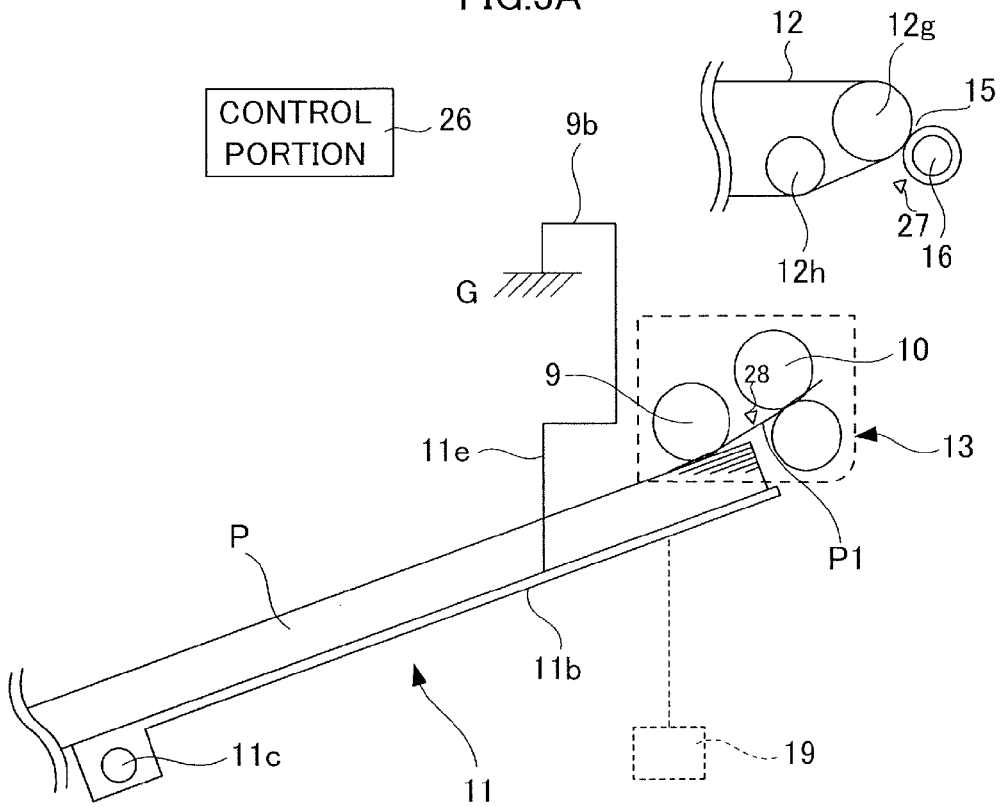
FIG. 3A is a side view schematically illustrating a state of a sheet feeding apparatus and a secondary transfer portion of a second embodiment in starting to feed a sheet.
Figure 3B:
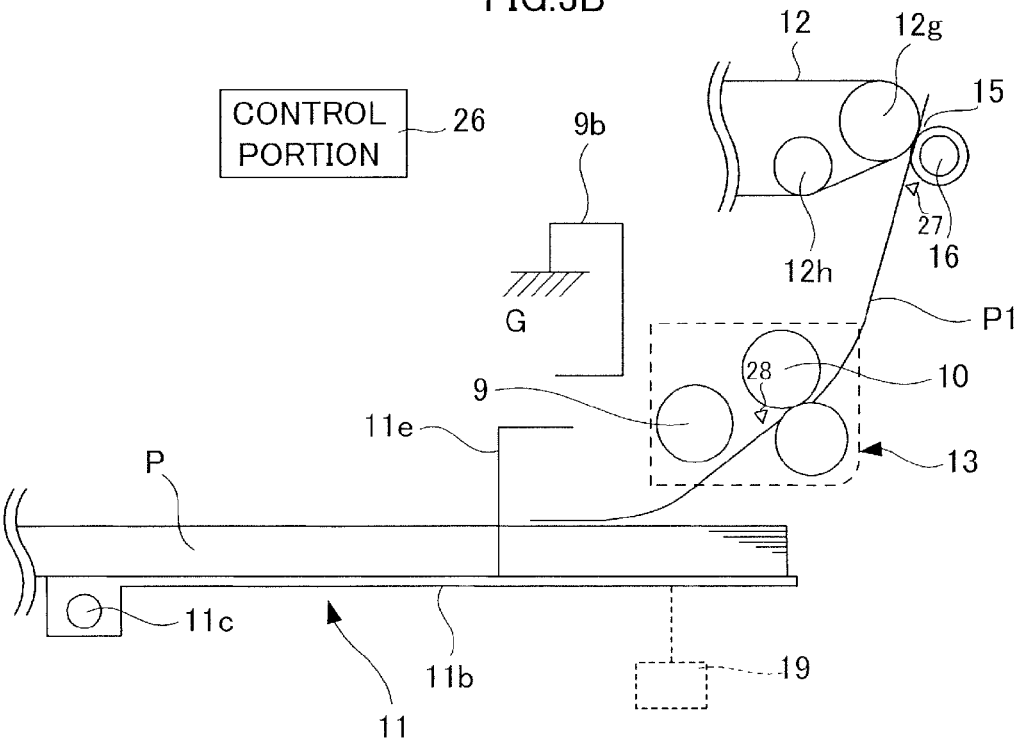
FIG. 3B is a side view schematically illustrating state of the sheet feeding apparatus and the secondary transfer portion of the second embodiment when the sheet reaches the secondary transfer portion.

Next, a second embodiment of the present invention will be described with reference to FIGS. 3A and 3B. It is noted that in the present embodiment, the same components with those of the first embodiment will be denoted by the same reference numerals, and an explanation of those having the same configuration and function will be omitted here. FIG. 3A illustrates state of the sheet feeding apparatus 13 and the secondary transfer portion 15 in starting to feed a sheet, and FIG. 3B illustrating a state when the sheet reaches the secondary transfer portion 15.

At first, the configuration of the sheet feed cassette 11 of the present embodiment will be described. The sheet feed cassette 11 includes the sheet supporting member 11*b* turnably supported by the apparatus body 100*a* at a fulcrum of the spindle 11*c*. A contacting/separating device (first contacting/separating device) 19 including a lifter mechanism composed of a driving source such as a motor not shown, and a spring is disposed between the apparatus body 100*a* (see FIG. 1) and the sheet supporting member 11*b*. A position of the feed roller 9 is fixed, and the contacting/separating device 19 lifts the sheet supporting member 11*b* to bring the sheet P stacked on the sheet supporting member 11*b* into contact with the feed roller 9. An uppermost sheet can be delivered by rotating the feed roller 9 in the condition in which the feed roller 9 is in contact with the sheet P.

The sheet supporting member 11*b* is formed of a conductive material and is connected with the conductive member 11*e* liftable together with the sheet supporting member 11*b*. Another end of the conductive member 9*b* whose one end is earthed to the ground G is disposed at a position connectable with the lifted conductive member 11*e*.

It is noted that in the present embodiment, the switching portion switching the sheet supporting member 11*b* between the grounded condition in which the sheet supporting member 11*b* is electrically earthed and the insulated condition in which the sheet supporting member 11*b* is electrically insulated is composed of the conductive members (first and second conductive members) 9*b* and 11*e*, and the contacting/separating device 19.

The sheet supporting member 11*b* is switched into the grounded condition when the sheet supporting member 11*b* is connected with the ground (grounding portion) G by the switching portion (9*b*, 11*e*, 19). This arrangement makes it possible to switch the sheet supporting member 11*b* on which the sheet P is stacked between the grounded condition and the insulated condition.

In the first state in which the front edge of the sheet P does not reach the secondary transfer portion 15, the control portion 26 controls the contacting/separating device 19 so as to connect the sheet supporting member 11*b* with the conductive member 9*b* and the conductive member 11*e* in linkage with the operation of bringing the feed roller 9 and the sheet P on the sheet supporting member 11*b* into contact with each other. Thereby, the sheet supporting member 11*b* is connected with the ground G and can be switched into the grounded condition. Still further, in the second state in which the front edge of the sheet P has reached the secondary transfer portion 15, the control portion 26 controls the contacting/separating device 19 so as to disconnect the conductive member 9*b* from the conductive member 11*e* and to switch the sheet supporting member 11*b* into the insulated condition in linkage with the operation of separating the feed roller 9 from the sheet P on the sheet supporting member 11*b*.

Next, operations of the sheet feeding apparatus 13 and the sheet feed cassette 11 of the present embodiment will be described with reference to FIGS. 3A and 3B.

As shown in FIG. 3A, the sheet supporting member 11*b* is lifted by the contacting/separating device 19 to a position where the sheet P can be fed and the sheet P stacked on the sheet supporting member 11*b* is biased by the feed roller 9 in feeding the sheet P within the sheet feed cassette 11. In response to the lift of the sheet supporting member 11*b*, the conductive member 11*e* conducting with the sheet supporting member 11*b* abuts and conducts with the other end of the conductive member 9*b*, so that the sheet supporting member 11*b* is connected with the ground G.

As shown in FIG. 3B, the sheet supporting member 11*b* is lowered by the contacting/separating device 19 when the front edge of the preceding sheet P1 reaches the secondary transfer portion 15 after ending the feed operation. As timing for lowering the sheet supporting member 11*b*, the control portion 26 controls the contacting/separating device 19 so as to lower the sheet supporting member 11*b* based on a signal of the first sheet sensor 27 detecting the front edge of the sheet P. When the sheet supporting member 11*b* is lowered as described above, the conductive member 11*e* separates from a lower end of the conductive member 9*b* on the apparatus body 100*a* side, so that the sheet supporting member 11*b* and the sheet P stacked thereon are switched into the insulated condition. It is noted that at this moment, the succeeding sheet P within the sheet feed cassette 11 and the sheet supporting member 11*b* are charged through the preceding sheet P1 by the transfer bias received at the secondary transfer portion 15.

When the feed operation is started again from the insulated condition, the control portion 26 controls the contacting/separating device 19 so as to lift the sheet supporting member 11*b*. Thereby, the conductive member 11*e* abuts and conducts with the conductive member 9*b* on the apparatus body 100*a* side, and the electric charge charged in the sheet P and the sheet supporting member 11*b* is discharged to the ground G. For instance, based on the signal of the second sheet sensor 28 detecting the rear edge of the sheet P, the control portion 26 controls the contacting/separating device 19 so as to lift the sheet supporting member 11*b* to bring the upper face of the stacked sheet P into contact with the feed roller 9. Thus, it is possible to reliably prevent the occurrence of the electrostatic noise otherwise causing the erroneous operation of the electronic components. According to the present embodiment, the charge and the discharge of the sheet P and the sheet supporting member 11*b* are repeated by lowering and lifting the sheet supporting member 11*b* every time when one sheet is delivered.

It is possible to prevent the occurrence of the double feeding and the feed failure otherwise caused by the electrostatic adsorption and to prevent the occurrence of the electrostatic noise by the arrangement described above. Then, because the electric charge is discharged per every one sheet, the electrostatic force is reduced accordingly and the double feeding can be prevented more effectively.

Third Embodiment

Figure 4A:
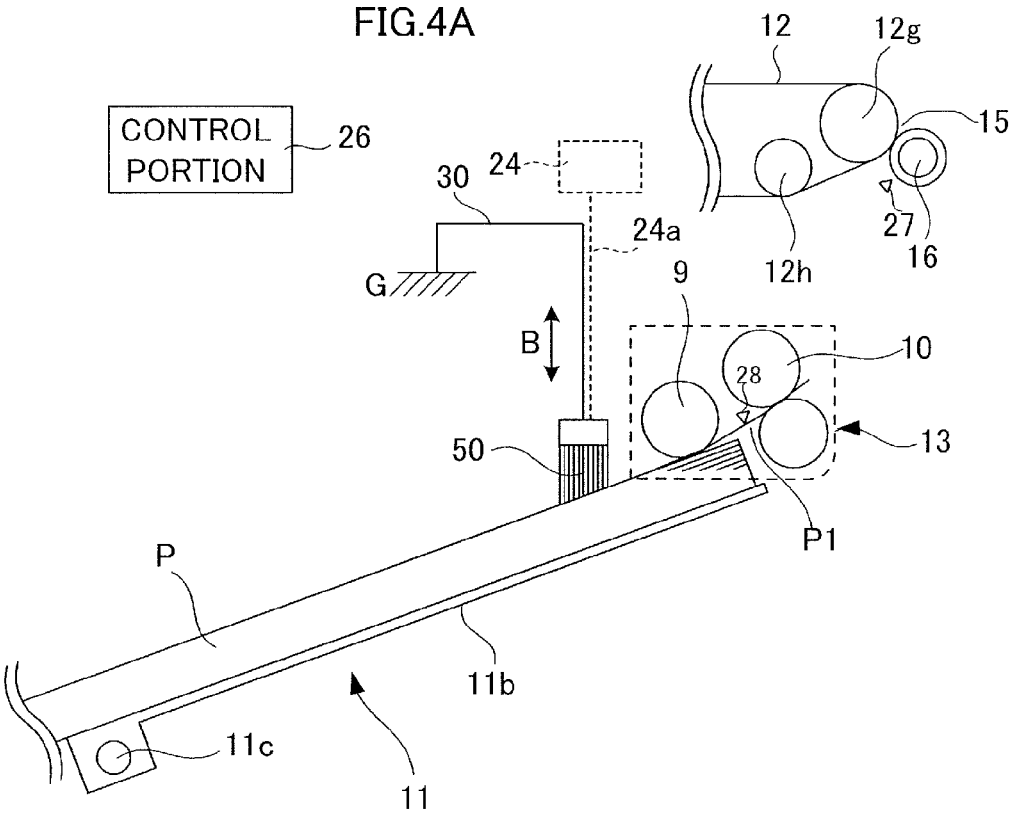
FIG. 4A is a side view schematically illustrating a state of a sheet feeding apparatus and a secondary transfer portion of a third embodiment in starting to feed a sheet.
Figure 4B:
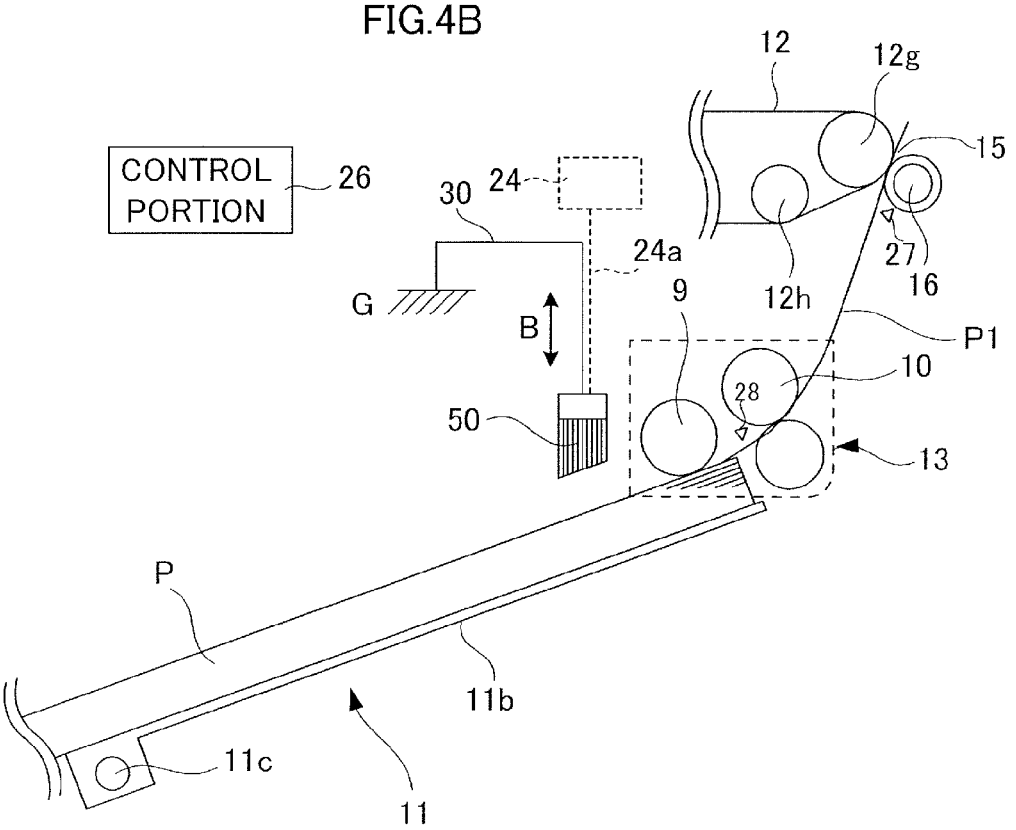
FIG. 4B is a side view schematically illustrating state of the sheet feeding apparatus and the secondary transfer portion of the third embodiment when the sheet reaches the secondary transfer portion.

Next, a third embodiment of the present invention will be described with reference to FIGS. 4A and 4B. It is noted that in the present embodiment, the same components with those of the first embodiment will be denoted by the same reference numerals, and an explanation of those having the same configuration and function will be omitted here. FIG. 4A illustrates state of the sheet feeding apparatus 13 and the secondary transfer portion 15 of the present embodiment in starting to feed a sheet, and FIG. 4B illustrates a state when the sheet reaches the secondary transfer portion 15 after being fed.

At first, the configuration of the present embodiment will be described. The apparatus body 100*a* includes a neutralizing brush 50 whose one end is connected with the ground G through a wire 30. The neutralizing brush 50 is supported by the apparatus body 100*a* movably in a direction of an arrow B and is configured to be switchable between contact and separate positions into contact with/separate from the sheet P stacked on the sheet supporting member 11*b* by a contacting/separating device (second contacting/separating device) 24 composed of a motor or a like not shown.

It is noted that in the present embodiment, the contacting/separating device 24 and the neutralizing brush (conductive member) 50 compose a switching portion switching the sheet P stacked on the sheet supporting member 11*b* between the grounded condition in which the sheet P is electrically earthed and the insulated condition in which the sheet P is electrically insulated. The contacting/separating device 24 actuates such that the neutralizing brush 50 conducted with the ground (grounding portion) G is brought into contact with/separate from the sheet P on the sheet supporting member 11*b*. That is, the contacting/separating device 24 brings the neutralizing brush 50 into contact with/separate from the sheet stacked on the sheet supporting member 11*b* and switches the sheet supporting member 11*b* between the grounded condition and the insulated condition by bringing the neutralizing brush 50 into contact with/separate from the stacked sheet.

In the first state in which the front edge of the sheet P does not reach the secondary transfer portion 15 (FIG. 4A), the control portion 26 of the present embodiment controls the contacting/separating device 24 such that the neutralizing brush 50 comes into contact with the sheet P on the sheet supporting member 11*b* to switch the sheet P into the grounded condition. In the second state in which the front edge of the sheet P reaches the secondary transfer portion 15 (FIG. 4B), the control portion 26 controls the contacting/separating device 24 such that the neutralizing brush 50 separates from the sheet P on the sheet supporting member 11*b* to switch the sheet P into the insulated condition.

The sheet supporting member 11*b* is switched into the grounded condition when the sheet supporting member 11*b* is connected with the ground (grounding portion) G by the switching portion (24, 50) and is switched into the insulated condition when the connection is disconnected by the switching portion. This arrangement makes it possible to switch the sheet P on the sheet supporting member 11*b* and the sheet supporting member 11*b* between the grounded condition and the insulated condition.

Next, operations of the sheet feeding apparatus 13 and the sheet feed cassette 11 of the present embodiment will be described with reference to FIGS. 4A and 4B.

As shown in FIG. 4A, the neutralizing brush 50 is brought into contact with the sheet P on the sheet supporting member 11*b* by the contacting/separating device 24 and the sheet P is put into the condition earthed to the ground G in feeding the sheet P1 within the sheet feed cassette 11.

Then, when the feed operation ends and the front edge of the preceding sheet P1 reaches the secondary transfer portion 15 as shown in FIG. 4B, the neutralizing brush 50 is separated from the preceding sheet P1 by the contacting/separating device 24 and the sheet P1 is switched into the insulated condition. As timing of this separation, the control portion 26 controls the contacting/separating device 24 so as to lift the neutralizing brush 50 based on the signal of the first sheet sensor 27 detecting the front edge of the sheet P. It is noted that at this moment, the succeeding sheet P within the sheet feed cassette 11 and the sheet supporting member 11*b* are charged through the preceding sheet P1 by the transfer bias received at the secondary transfer portion 15.

When the feed operation is started again from the insulated condition, the neutralizing brush 50 is lowered by the contacting/separating device 24 and comes into contact and conducts with the sheet P on the sheet supporting member 11*b*. Then, the electric charge charged in the sheet P and the sheet supporting member 11*b* is discharged to the ground G. The control portion 26 controls the contacting/separating device 24 so as to lower the neutralizing brush 50 so that the neutralizing brush 50 comes into contact with the upper face of the sheet P based on the signal of the second sheet sensor 28 detecting the rear edge of the sheet P. Thereby, it is possible to reliably prevent the occurrence of the electrostatic noise otherwise causing the erroneous operation of the electronic components. As described above, according to the present embodiment, the charge and discharge of the sheet P and the sheet supporting member 11*b* are repeated by lowering and lifting the neutralizing brush 50 every time when one sheet is delivered.

According to the present embodiment, it is possible to prevent the occurrence of the double feeding and the feed failure otherwise caused by the electrostatic adsorption and to prevent the occurrence of the electrostatic noise by the configuration described above. Then, the electric charge is discharged per every one sheet, so that the electrostatic force is small accordingly and it is more effective to prevent the double feeding. It is noted that while the neutralizing brush 50 is moved by the contacting/separating device 24 in the present embodiment, it is also possible to bring the upper face of the stacked sheet P into contact with/separate from the neutralizing brush 50 by fixing the neutralizing brush 50 and lifting the sheet supporting member 11*b* as described in the second embodiment.

Fourth Embodiment

Figure 5A:
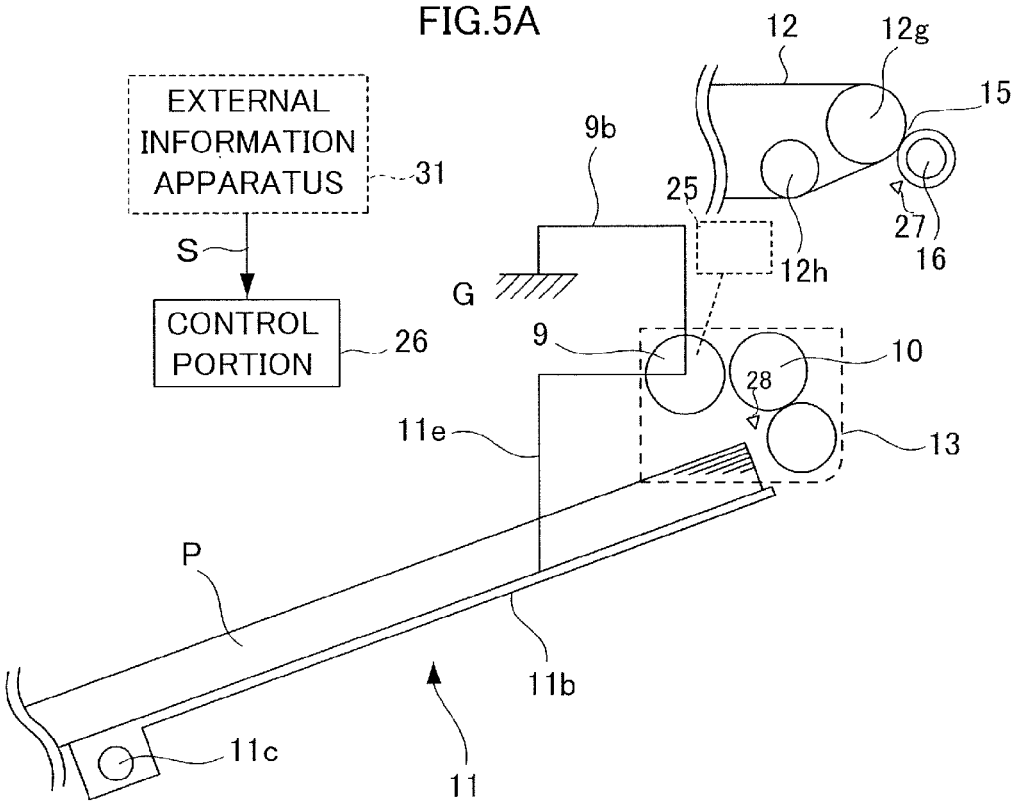
FIG. 5A is a side view schematically illustrating a sheet feeding apparatus and a secondary transfer portion of a fourth embodiment in a standby condition in which no sheet is conveyed.
Figure 5B:
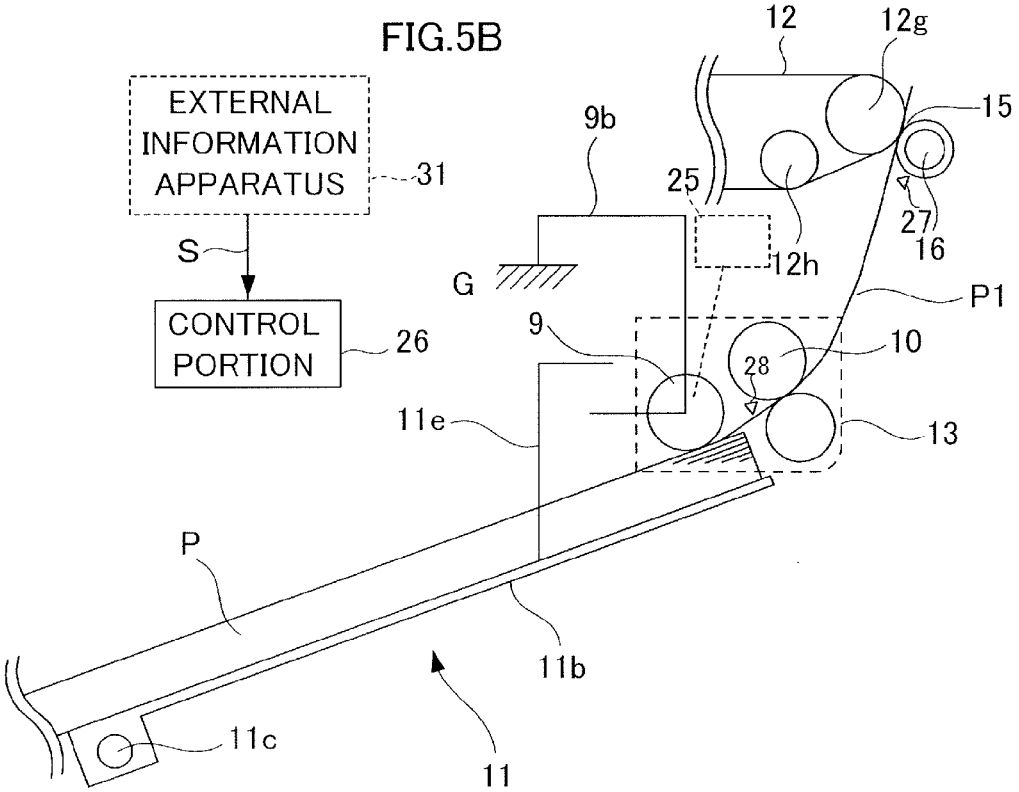
FIG. 5B is a side view schematically illustrating a sheet feeding apparatus and a secondary transfer portion of the fourth embodiment in a feed condition in which an apparatus body conveys a preceding sheet by receiving a print signal from an external information device.

Next, a fourth embodiment of the present invention will be described with reference to FIGS. 5A and 5B. It is noted that in the present embodiment, the same portions with those of the first embodiment will be denoted by the same reference numerals, and an explanation of those having the same configuration and function will be omitted here. FIG. 5A illustrates a standby condition in which no sheet is conveyed in the apparatus body 100*a*, and FIG. 5B illustrates a feed condition in which sheets are fed consecutively by receiving a consecutive print signal (image forming signal) S from an external information device (external device) 31 such as a personal computer (PC).

In the present embodiment, the conductive members 9*b* and 11*e*, and a contacting/separating device (first contacting/separating device) 25 composes a switching portion switching the sheet feed cassette 11 between a grounded condition in which the sheet feed cassette 11 is electrically earthed and an insulated condition in which the sheet feed cassette 11 is electrically insulated. Still further, the control portion 26 of the present embodiment controls the switching portion (9*b*, 11*e*, 25) such that the sheet feed cassette 11 is switched into the grounded condition in a standby state in which no consecutive print signal (image forming signal) S is inputted from the external information device (external device) 31 (see FIG. 5A). Then, in the feed state in which the sheets P on the sheet feed cassette 11 are consecutively fed based on the consecutive print signal S from the external information device 31 (see FIG. 5B), the control portion 26 controls the switching portion (9*b*, 11*e*, 25) such that the sheet feed cassette 11 is switched into the insulated condition. That is, in the feed state during one job for example, the control portion 26 controls the switching portion (9*b*, 11*e*, 25) such that the feed roller 9 consecutively feeds the sheets and keeps the state in which the feed roller 9 is in contact with the sheet on the sheet supporting member 11*b*. Still further, in the standby state during when one job ends and a next job is to be inputted as a consecutive print signal S, the feed roller 9 and the sheet on the sheet supporting member 11*b* are kept in the standby state in which the feed roller 9 is separated from the sheet on the sheet supporting member 11*b*.

According to the present embodiment, the sheet supporting member 11*b* is switched into the grounded condition when the sheet supporting member 11*b* is connected with the ground (grounding portion) G through the conductive members 9*b* and 11*e* by the switching portion (9*b*, 11*e*, 25). Then, the sheet supporting member 11*b* is switched into the insulated condition when the conductive member 9*b* is disconnected from the conductive member 11*e* by the switching portion (9*b*, 11*e*, 25).

As described above, the sheet supporting member 11*b* is switched into the grounded condition by being connected with the ground (grounding portion) G by the switching portion (9*b*, 11*e*, 25) and is switched into the insulated condition when the connection is disconnected by the switching portion. This arrangement makes it possible to switch the sheet feed cassette 11 on which the sheet P is stacked between the grounded condition and the insulated condition.

The contacting/separating device 25 of the switching portion includes a driving source composed of a motor or the like not shown and brings the feed roller 9 into contact with/separate from the sheet supporting member 11*b*.

In the standby state shown in FIG. 5A, the control portion 26 of the present embodiment controls the contacting/separating device 25 such that the conductive member 9*b* is connected with the conductive member 11*e* in linkage with the operation of separating the feed roller 9 from the sheet P on the sheet supporting member 11*b*. Thereby, the sheet supporting member 11*b* is connected with the ground G and is switched into the grounded condition. Still further, in the feed state, the control portion 26 controls the contacting/separating device 25 such that the conductive member 9*b* is disconnected from the conductive member 11*e* and the sheet supporting member 11*b* is switched into the insulated condition in linkage with the operation of bringing the feed roller 9 into contact with the sheet P on the sheet supporting member 11*b*.

The control portion 26 controls the switching portion (9*b*, 11*e*, 25) such that the sheet supporting member 11*b* is switched between the grounded condition and the insulated condition every time when the consecutive feed of consecutively feeding a plurality of sheets stacked on the sheet supporting member 11*b* is started and finished. Still further, in the feed state in which the feed roller 9 consecutively feeds the stacked sheets, the control portion 26 switches the sheet supporting member 11*b* into the insulated condition and in the standby state in which the feed roller 9 stands by without feeding any stacked sheet, the control portion 26 switches the sheet supporting member 11*b* into the grounded condition.

In a state in which printing has been finished and the apparatus body 100*a* is not in a condition of conveying the sheet P as shown in FIG. 5A, the feed roller 9 is separated from the sheet P by the contacting/separating device 25. For instance, the control portion 26 controls the contacting/separating device 25 so as to lift up the feed roller 9 to switch the sheet supporting member 11*b* into the insulated condition based on a signal of the second sheet sensor 28 detecting a rear edge of a final sheet of a job. In response to the lift up of the feed roller 9 to separate from the sheet P, the conductive member 11*e* on the sheet supporting member 11*b* side comes into contact and conducts with the conductive member 9*b* on the feed roller 9 side, and the electric charge charged in the sheets and the sheet supporting member 11*b* is discharged to the ground G. Thereby, it is possible to prevent the occurrence of the electrostatic noise otherwise causing the erroneous operation of the electronic components.

In a state in which the apparatus body 100*a* consecutively feeds the sheets by receiving the consecutive print signal (image forming signal) S from the external information device 31 as shown in FIG. 5B, the feed roller 9 is brought into contact with the sheet P1 and the contact state is maintained by the contacting/separating device 25. When the feed roller 9 is lowered to bring into contact with the sheet P1, the conductive member 9*b* of the feed roller 9 separates from the conductive member 11*e* of the sheet supporting member 11*b* and the sheet P1 and the sheet supporting member 11*b* are switched into the insulated condition. For instance, the control portion 26 controls the contacting/separating device 25 so as to lower the feed roller 9 based on the signal of the first sheet sensor 27 detecting the front edge of a first sheet of a job. It is noted that when the sheets are consecutively fed after that, the sheets P within the sheet feed cassette 11 and the sheet supporting member 11*b* are gradually charged through the preceding sheet P1 by the transfer bias received at the secondary transfer portion 15.

The case of executing the control of consecutively feeding the sheets in the state in which the feed roller 9 is in contact with the upper face of the sheet stacked on the sheet supporting member 11*b* has been described in the present embodiment. That is, this is a control in consecutively feeding the sheets without separating the feed roller 9 from the sheet in consecutively forming images on a predetermined number of sheets of one job or in consecutively forming images on a predetermined number of sheets set in advance.

It is possible to prevent the occurrence of the double feeding and the feed failure otherwise caused by the electrostatic adsorption and to prevent the electrostatic noise from being generated. Still further, the insulated condition of the sheet P continues until printing finishes, it is possible to reliably prevent the occurrence of the double feeding and the feed failure otherwise caused by the electrostatic adsorption even for a lengthy sheet. Still further, because a number of times of the contacting/separating operations of the feed roller 9 made by the contacting/separating device 25 is small, there are such advantages that operational noise is low and that a life of the apparatus is prolonged.

It is noted that although the grounded condition and the insulated condition of the sheet P and the sheet supporting member 11*b* are switched by bringing the feed roller 9 into contact with/separate from the sheet P in the embodiment, the present invention is not limited to such configuration. For instance, it is also possible to switch the grounded condition and the insulated condition by lifting/lowering the sheet supporting member 11*b* or by bringing the neutralizing brush 50 in contact/separate from the sheet by adopting either configuration of the first through third embodiments.

Still further, although the case of determining the timing for switching the grounded condition and the insulated condition based on the detection signals of the first and second sheet sensors has been exemplified in the respective embodiments described above, the present invention is not limited to such configuration. For instance, it is possible to detect a front edge and a rear edge of a sheet being fed by one sensor disposed between the feed roller 9 and the secondary transfer portion 15 and to set the timing based on a detection signal thereof. Still further, because a time from when a sheet is started to be fed by a feed signal until when a front edge of the sheet reaches the secondary transfer portion 15 and when a rear edge of the sheet passes through the feed roller 9 is known in advance, it is also possible to switch the grounded condition and the insulated condition based on this time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-219968, filed Oct. 29, 2014 which is hereby incorporated by reference herein in its entirety.

What is claimed is:

1. An image forming apparatus, comprising:

a sheet stacking portion on which a sheet is stacked;

a feed portion feeding the sheet stacked on the sheet stacking portion;

a transfer portion transferring a toner image onto the sheet fed by the feed portion by a transfer bias applied to the transfer portion;

a first conductive member electrically connected with a grounding portion;

a second conductive member provided contactably with the first conductive member and configured to electrically connect with the sheet stacking portion;

a switching portion bringing the first conductive member into contact with the second conductive member and separating the first conductive member from the second conductive member, switching the sheet stacking portion into a grounded condition in response to contacting the first conductive member with the second conductive member, and switching the sheet stacking portion into an insulated condition in response to separating the first conductive member from the second conductive member; and a control portion controlling the switching portion such that the sheet stacking portion is switched from the grounded condition to the insulated condition every time one stacked sheet is fed.

2. The image forming apparatus according to claim 1, further comprising a sheet position sensor detecting whether or not a front edge of a sheet whose rear edge is in contact with the stacked sheet has reached the transfer portion, wherein the control portion detects whether or not the front edge of the sheet whose rear edge is in contact with the stacked sheet has reached the transfer portion by the sheet position sensor and switches the sheet stacking portion into the insulated condition when the front edge of the sheet whose rear edge is in contact with the stacked sheet has reached the transfer portion.

3. An image forming apparatus, comprising:

a sheet stacking portion on which a sheet is stacked;

a feed portion feeding the sheet stacked on the sheet stacking portion;

a transfer portion transferring a toner image onto the sheet fed by the feed portion by a transfer bias applied to the transfer portion;

a first conductive member electrically connected with a grounding portion;

a second conductive member contactable with the first conductive member and configured to electrically connect with the sheet stacking portion;

a switching portion bringing the first conductive member into contact with the second conductive member and separating the first conductive member from the second conductive member, switching the sheet stacking portion into a grounded condition in response to contacting the first conductive member with the second conductive member, and switching the sheet stacking portion into an insulated condition in response to separating the first conductive member from the second conductive member; and a control portion controlling the switching portion such that the sheet stacking portion is switched between the grounded condition and the insulated condition every time consecutively feeding a plurality of stacked sheets is started and finished, wherein the stacking portion is in the insulated condition in a feed state in which the feed portion consecutively feeds the stacked sheets and is in the grounded condition in a standby state in which the feed portion stands by without feeding any stacked sheet.

4. An image forming apparatus, comprising:

a sheet stacking portion on which a sheet is stacked;

a feed portion feeding the sheet stacked on the sheet stacking portion;

a transfer portion transferring a toner image onto the sheet fed by the feed portion;

a first conductive member electrically connected with a grounding portion;

a second conductive member provided contactable with the first conductive member and configured to electrically connect with the sheet stacking portion;

a switching portion bringing the first conductive member into contact with the second conductive member and separating the first conductive member from the second conductive member, switching the sheet stacking portion into a grounded condition in response to contacting the first conductive member with the second conductive member, and switching the sheet stacking portion into an insulated condition in response to separating the first conductive member from the second conductive member; and a control portion controlling the switching portion such that the stacked sheet is switched into the grounded condition in a state in which a front edge of a preceding sheet fed by the feed portion does not reach the transfer portion and such that the stacked sheet is switched into the insulated condition from the grounded condition in a state in which the front edge of the preceding sheet whose rear edge is in contact with the stacked sheet reaches the transfer portion.

5. The image forming apparatus according to claim 4, wherein the stacked sheet is switched into the grounded condition when the sheet stacking portion is electrically connected with the grounding portion by the switching portion and the stacked sheet is switched into the insulated condition when the sheet stacking portion is electrically disconnected from the grounding portion by the switching portion.

6. The image forming apparatus according to claim 5, wherein the switching portion includes a first contacting and separating device that moves at least one of the feed portion and the sheet stacking portion to bring the feed portion or the stacked sheet into contact with or separate from the other of the feed portion or the stacked sheet, and wherein the control portion controls the first contacting and separating device to switch the stacked sheet into the grounded condition in linkage with an operation of bringing the feed portion and the stacked sheet into contact with each other and to switch the stacked sheet into the insulated condition in linkage with an operation of separating the feed portion from the stacked sheet.

7. The image forming apparatus according to claim 6, wherein the first and second conductive members are connected and the stacked sheet is switched into the grounded condition in response to the contact of the feed portion with the stacked sheet made by the first contacting and separating device by moving the feed portion, and wherein the connection of the first and second conductive members is disconnected and the stacked sheet is switched into the insulated condition in response to the separation of the feed portion from the stacked sheet made by the first contacting and separating device by moving the feed portion.

8. The image forming apparatus according to claim 6, wherein the first and second conductive members are connected and the stacked sheet is switched into the grounded condition in response to the contact of the stacked sheet with the feed portion made by the first contacting/separating device by moving the sheet stacking portion, and wherein the connection of the first and second conductive members is disconnected and the stacked sheet is switched into the insulated condition in response to the separation of the stacked sheet from the feed portion made by the first contacting/separating device by moving the sheet stacking portion.

9. An image forming apparatus, comprising:

a sheet stacking portion on which a sheet is stacked;

a feed portion feeding the sheet stacked on the sheet stacking portion;

a transfer portion transferring a toner image onto the sheet fed by the feed portion;

a switching portion switching the stacked sheet between a grounded condition in which the stacked sheet is electrically grounded and an insulated condition in which the stacked sheet is electrically insulated; and a control portion controlling the switching portion such that the stacked sheet is switched into the grounded condition in a state in which a front edge of a preceding sheet fed by the feed portion does not reach the transfer portion and controlling the switching portion such that the stacked sheet is switched into the insulated condition from the grounded condition in a state in which the front edge of the preceding sheet whose rear edge is in contact with a succeeding sheet of the stacked sheet reaches the transfer portion, wherein the switching portion includes a conductive member electrically connected with a grounding portion and a contacting and separating device bringing the conductive member into contact with and separating the conductive member from the stacked sheet, and wherein the control portion controls the contacting and separating device to switch the stacked sheet into the grounded condition by bringing the conductive member in contact with the stacked sheet and to switch the stacked sheet into the insulated condition by separating the conductive member from the stacked sheet.

* * * * *